US006384326B1

(12) United States Patent
McFadden et al.

(10) Patent No.: US 6,384,326 B1
(45) Date of Patent: May 7, 2002

(54) CABLE SHIELD CLOSURE

(75) Inventors: Jeff McFadden, Blairstown, NJ (US); Richard Thibeau, Groton, MA (US)

(73) Assignee: Laird Technologies, Inc., Delaware Water Gap, PA (US)

( * ) Notice: Subject to any disclaimer, the term of this patent is extended or adjusted under 35 U.S.C. 154(b) by 0 days.

(21) Appl. No.: 09/655,527

(22) Filed: Sep. 5, 2000

(51) Int. Cl.[7] ..... H01B 7/34
(52) U.S. Cl. ..... 174/36
(58) Field of Search ..... 174/36, 113 R, 174/102 R; 138/158, 169, 170, DIG. 1

(56) References Cited

U.S. PATENT DOCUMENTS 3,703,605 A * 11/1972 Dembiak et al. ..... 174/36 X
5,030,794 A * 7/1991 Schell et al. ..... 174/36

OTHER PUBLICATIONS

Hawley "Condensed Chemical Dictionary" 1981.*

* cited by examiner

*Primary Examiner*—Chau N. Nguyen
(74) *Attorney, Agent, or Firm*—Pitney, Hardin, Kipp & Szuch LLP

(57) ABSTRACT

A cable shield and method of formation, more specifically, a closure including an adhesive strip on two surfaces, which is dry to the touch and which will adhere to the complementary adhesive strip, but substantially nothing else.

18 Claims, 1 Drawing Sheet

CABLE SHIELD CLOSURE

BACKGROUND OF THE INVENTION

The invention relates generally to cable shields and more particularly to a cable shield closed with an adhesive composition.

It is known to cover cables that carry electrical signals with RF or electromagnetic (hereinafter collectively "RF") shields formed, for example, with conductive fabric or foil overwraps that are closed or sealed by various methods. Some methods employ snap buttons, but this can lack permanence and can be lead to leakage between the snap points. Other closures employ zippers, hook and loop closures and rib-in-groove closures. However, such closures also lack sufficient permanence or durability and can lead to unsatisfactory RF shields.

It is also known to close cable shields with adhesives. Some adhesive are applied in a liquid state and can be inconvenient to use. Others are covered with release strips, but can be difficult to use if the adhesive coated portion unintentionally contacts the wrong location of the cable shield, or some other object such that repositioning can be difficult and closures having a sloppy appearance, loose or too fight a fit or unsatisfactory shielding can result.

Accordingly, it is desirable to provide an improved cable shield and method of closing the cable shield, which overcomes disadvantages of the prior art.

SUMMARY OF THE INVENTION

Generally speaking, in accordance with the invention, a cable shield is provided in the form of a sheet having top and bottom surfaces and can include permanent adhesive compositions at edges thereof which can be dry to the touch and which will only bond at the desired location. Adhesives in accordance with preferred embodiments in the invention can also stay unbonded or weakly bonded for sufficiently long periods of time to permit readjustment of the closure, so that the desired fit can be achieved.

The shield can be formed as an elongated sheet with a top/inner surface which will wrap around the cable and a bottom, outer surface, which will face outwards from the cable. The adhesive composition can be disposed as a thin strip at least along one edge of the upper surface of the shield, and as a corresponding complementary thin strip on the lower surface, along the opposite edge, so that when the shield is wrapped around the cable, the strips of the adhesive composition can be contacted to each other. The adhesive is advantageously a pressure sensitive type of adhesive, which can be permanent in nature, which can be formed with a mixture of solid particles in sufficient volume or location that the adhesive will be dry to the touch and substantially only bond to another surface containing the same or similar adhesive. Thus, the solid particles can occupy sufficient area of the surface, so that there is substantially no adhesive bonding when the adhesive contacts most materials. However, when a first coat of adhesive contacts a second surface coated with the adhesive, and pressure is applied, sufficient deformation of the adhesive layers is achieved, such that the pressure sensitive adhesive materials from each coating portion come in contact with each other and the two layers bond together. By using electrically conductive solid particles, such as metallic particles, the adhesive bond itself can be made electrically conductive and improve the RF shielding properties of the closure.

Accordingly, it is an object of the invention to provide an improved cable shield.

Another object of the invention is to provide an improved method of making and closing a cable shield.

The invention accordingly comprises the several steps and the relation of one and more of such steps with respect to each of the others, and the article possessing the features, properties, and the relation of elements, which are exemplified in the following detailed disclosure, and the scope of the intentional will be indicated in the claims.

BRIEF DESCRIPTION OF THE DRAWINGS

For a fuller understanding of the invention, reference is had to the following description, taking in connection with the accompanying drawings, in which.

DETAILED DESCRIPTION OF THE PREFERRED EMBODIMENTS

Figure 1:
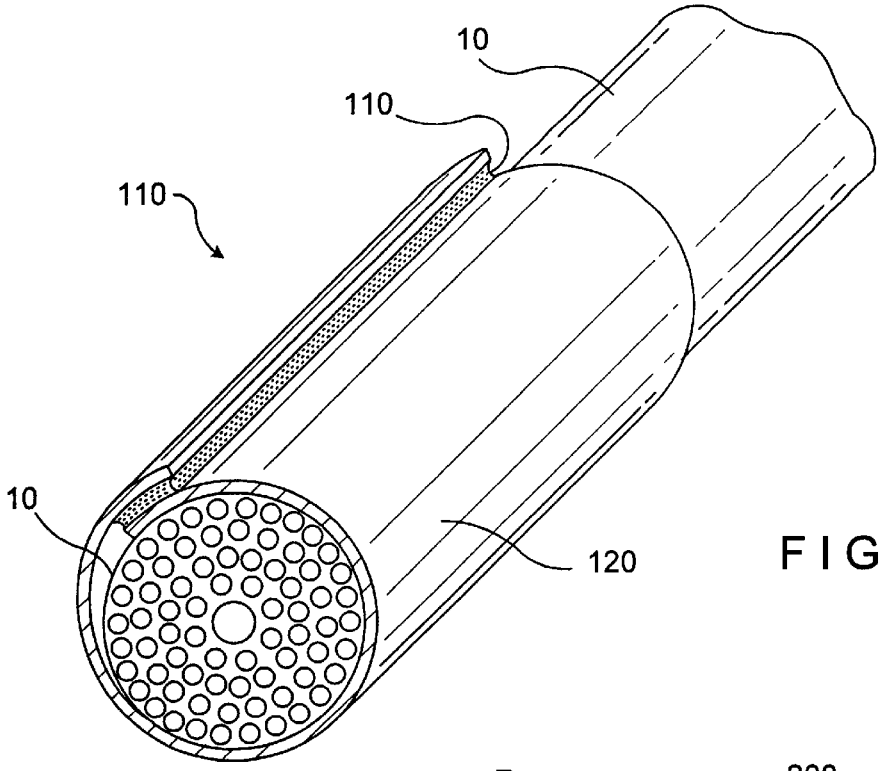
FIG. 1 is a perspective view of a cable shield with a closure, in accordance with preferred embodiments of the invention.

A cable 10 having a cable shield 100 disposed thereover is shown in FIG. 1. Cable 10 is constructed to transmit an electrical signal. Cable shield 100 is constructed to act as a RF shield, for the purpose of shielding RF emissions from cable 10 or preventing cable 10 from being subjected to RF interference from other sources.

Cable shield 100 is formed with an overwrap portion 120 in the form of a sheet elongated in the length direction of the cable and is closed with an adhesive portion 110. Overwrap 120 can be formed with various known conductive fabrics, foils, or metallized fabrics or elastomers. Adhesive 110 is advantageously a pressure sensitive type of adhesive which is normally dry to the touch, will not adhere to most surfaces, including the surface of overwrap 120 and which will bond to a corresponding complementary adhesive coating when pressure is applied.

Figure 2:
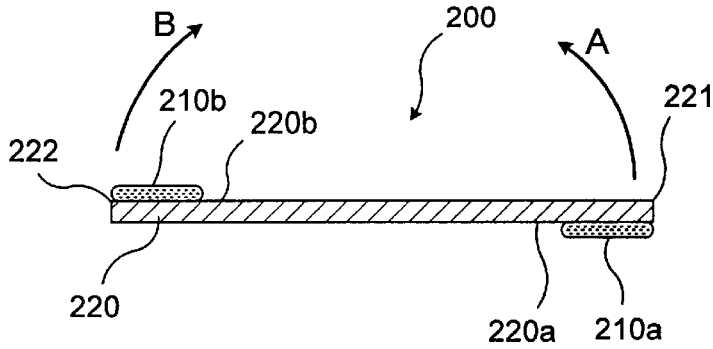
FIG. 2 is a cross-sectional view of a cable shield in accordance with preferred embodiments of the invention.
Figure 3:
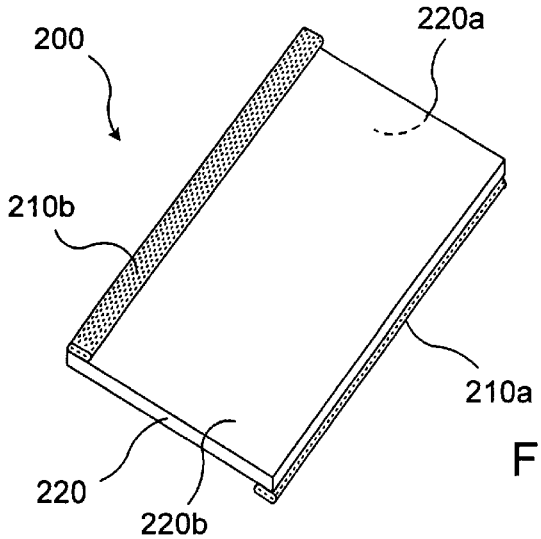
FIG. 3 is a perspective view of the cable shield of FIG. 2.

An open cable shield 200, constructed in accordance with preferred embodiments of the invention is shown generally in FIGS. 2 and 3, which along with FIG. 1, are not necessarily drawn to scale. Cable shield 200 includes an overwrap portion 220 which includes an upper inner surface 220*b* and a lower, outer surface 220*a*. A strip of adhesive component 210*a* is formed on outer surface 220*a* along edge 221 of overwrap 220 and a matching strip of adhesive component 210*b* is formed on inner surface 220*b* of overwrap 220, along an edge 222, opposite edge 221. In use, edge 221 of overwrap 200 is curved up and around a cable, in the direction of arrow A. Opposite edge 222 is drawn up and around a cable, in the direction of arrow B, such that adhesive strip 210*a* is made to contact adhesive strip 210*b*. In another embodiment of the invention, adhesive strip 210*a* can be formed on inner surface 220*b* of overwrap 220 and adhesive strip 210*b* can be formed on outer surface 220*a*, along edge 222 of overwrap 220. The adhesive strips can also be formed on both sides along one edge or over the entire surface. It is advantageous, but not mandatory that the two complementary adhesive strips are formed on opposite surfaces of the shield so that the edges of the shield lay flat when the two adhesive strips are contacted.

Adhesive 110 is advantageously dry to the touch and will not adhere to most surfaces as a result of, for example, of the inclusion of sufficient solid particles in the adhesive material, so that there is insufficient bonding surface exposed. However, when a coating of the adhesive of a first surface is contacted to a complementary coating of adhesive on a second surface and pressure is applied, there is sufficient deformation of the adhesive layers, such that the pressure sensitive adhesive material from each coating comes in contact and bonds the two layers together. By forming the solid particles from electrically conductive material, such as metal particles, the bond itself can be later conductive.

In one embodiment of the invention, the adhesive is provided as two portions which are pressed together to close the shield around a cable. Both of the portions can contain a pressure sensitive adhesive, such as a silicone, acrylic, or rubber composition filled with solid particles. In this manner, adhesive strips can be coated along opposite edges of the shield and such edges will bond to each other, but not the uncoated portion of the shield. In one embodiment of the invention, the uncoated portion of the shield can be coated with release agent, such as various known release agents, to help prevent forming a bond at an undesired location.

It is also advantageous to formulate the adhesive to have a suitable time before the bond becomes permanent, to permit adjustments, after the opposing adhesive strips are contacted. A weak, temporary bond is formed when the adhesive strips contact. They may be separated and repositioned. Only after firm pressure is applied will the bond become permanent.

Various known pressure sensitive adhesive materials can be used in formulating the adhesive in accordance with the invention. Suitable non-limiting examples of adhesive materials include silicones, acrylics, thermoplastic elastomers, and rubbers. A particularly well suited adhesive is a silicone based adhesive, sold under the tradename Q2 7406 from Dow Corning of Midland, Mich. Additional components may be mixed with the adhesive including curing agents, solvents, coupling agents, and colorants. A particularly well suited coupling agent is an aminosilane coupling agent, sold under the tradename Z6020, by Dow Corning of Midland, Mich.

Examples of solvents and diluents include xylene, toluene, and methyl chloroform. A particularly preferred solvent is xylene.

Various known powders can be used to formulate adhesive in accordance with the invention, including glass beads, metal particles, metallized particles, and non-metal particles such a graphite. Preferred powders are silver powders and in particular, silver powders sold under the trade designation NX4005, by Engelhard of East Newark, N.J. The particles sizes preferably range from 1 $\mu$m to 50 $\mu$m. The particles preferably comprise 30% to 70% by volume of the adhesive composition.

The width and height of the adhesive strips depend in part on the type, size and use of the closure. For many application, strips 0.1 inch to 2 inches wide and strips 0.002 inch to 0.040 inches high are acceptable. In general, the width of the two complementary strip is substantially equal.

Suitable adhesives are described in French patent no. 2698876, the contents of which are incorporated herein by reference. A particularly well suited adhesive is the Dry-Touch Conductive Adhesive sold by Altoflex of France.

It will thus be seen that the objects set forth above, among those made apparent from the preceding description, are efficiently attained and, since certain changes may be made in carrying out the above method and in the article set forth, without departing from the spirit and the scope of the invention, it is intended that all matter contained in the above description and shown in the accompanying drawings, should be interpreted as illustrative and not in a limiting sense.

It is also to be understood that the following claims are intended to cover all of the generic and specific features of the invention herein described and all statements of the scope of the invention which, as a matter of language, might be said to fall therebetween Particularly, it is too be understood that in said claims, ingredients are compounds recited in the singular are intended to include compatible mixtures of such ingredients wherever the sense permits.

What is claimed is:

1. A cable shield for a cable which transmits an electrical signal, comprising:

an overwrap portion in the form of an electrically conductive sheet having an upper surface and a lower surface, the sheet constructed to be wrapped around and act as an RF shield to a cable which transmits an electrical signal, the sheet having opposite edges which can meet in overlapping engagement when the sheet is wrapped around the cable; a first dry conductive adhesive portion disposed along one of said edges and a second dry conductive adhesive portion, formulated to bond with the first adhesive portion and form an adhesive bond therewith disposed on the opposite edge of the sheet, and the adhesive portions are positioned and the sheet is constructed and arranged such that when the sheet is wrapped around the cable having a circumference smaller than the distance between the two edges, the first and second adhesive portions can be brought into contact and form the adhesive bond, and each adhesive portion formulated so that it does not bond to the material of the sheet.

2. The shield of claim 1, wherein the first and second adhesive portions include particles in sufficient volume at least at the surface thereof, to substantially prevent the adhesive portions from adhering to the material of the sheet.

3. The shield of claim 2, wherein the particles component comprises conductive particles.

4. The shield of claim 3, wherein the conductive particles component comprises silver particles.

5. The shield of claim 2, wherein the particles comprise about 30 to 70% by volume of each adhesive portion.

6. The shield of claim 2, wherein the particles have a mean diameter from about 1 to 50 microns.

7. The shield of claim 1, wherein said first and second adhesive portions are formulated to form a permanent bond to each other only after sufficient pressure is applied to said first and second adhesive portions while they are in contact with each other.

8. The shield of claim 1, wherein at least the first adhesive portion comprises silicone-based adhesive material.

9. The shield of claim 1, wherein the first and second adhesive portions have substantially the same composition.

10. The shield of claim 1, wherein a release agent is disposed on portions of the sheet not coated with adhesive material.

11. A method of constructing a cable shield, comprising:

providing a sheet of RF shielding material having a first surface and a second surface and opposite first and second edges;

disposing a first dry conductive adhesive portion containing a pressure sensitive adhesive on said first surface of the sheet at least along said first edge;

disposing a second dry conductive adhesive portion on said second edge, the first and second adhesive portions formulated to resist adhesion to the material of the sheet, but form a bond when pressed together.

12. The method of claim 11, wherein the second portion is coated on said second surface opposite said first surface bearing the first portion.

13. The method of claim 11, wherein the first and second adhesive portions include particles in sufficient volume at least at the surface thereof, to substantially prevent the adhesive portions from adhering to the material of the sheet.

14. The method of claim 11, wherein the first and second adhesive portions have substantially the same composition.

15. The method of claim 11, wherein at least the first adhesive portion comprises silicone-based adhesive material.

16. The method of claim 15, wherein the first and second adhesive portions have substantially the same composition.

17. A cable shield for a cable which transmits an electrical signal, comprising:

an overwrap portion in the form of an electrically conductive sheet having an upper surface and a lower surface, the sheet constructed to be wrapped around and act as an RF shield to a cable which transmits an electrical signal, the sheet having opposite edges which can meet in overlapping engagement when the sheet is wrapped around the cable; a first adhesive portion disposed along one of said edges and a second adhesive portion, formulated to bond with the first adhesive portion and form an adhesive bond therewith disposed on the opposite edge of the sheet, and the adhesive portions are positioned and the sheet is constructed and arranged such that when the sheet is wrapped around the cable having a circumference smaller than the distance between the two edges, the first and second adhesive portions can be brought into contact and form the adhesive bond, and each adhesive portion formulated so that it does not bond to the material of the sheet;

wherein the first and second adhesive portions include particles in sufficient volume at least at the surface thereof, to substantially prevent said first and second adhesive portions from adhering to the material of the sheet.

18. A method of constructing a cable shield, comprising:

providing a sheet of RF shielding material having a first surface and a second surface and opposite first and second edges;

disposing a first adhesive portion containing a pressure sensitive adhesive on said first surface of the sheet at least along said first edge;

disposing a second adhesive portion on said second edge, the first and second adhesive portions formulated to resist adhesion to the material of the sheet, but form a bond when pressed together;

wherein the second portion is coated on said second surface opposite said first surface bearing the first portion;

wherein the first and second adhesive portions include particles in sufficient volume at least at the surface thereof, to substantially prevent said first and second adhesive portions from adhering to the material of the sheet.

* * * * *